US006913161B2

(12) United States Patent
Schäfer

(10) Patent No.: US 6,913,161 B2
(45) Date of Patent: Jul. 5, 2005

(54) COLLAPSIBLE STORAGE OR SHIPPING BOX

(75) Inventor: Gerhard Schäfer, Neunkirchen (DE)

(73) Assignee: Fritz Schafer GmbH, Neunkirchen (DE)

( * ) Notice: Subject to any disclaimer, the term of this patent is extended or adjusted under 35 U.S.C. 154(b) by 0 days.

(21) Appl. No.: 10/677,812

(22) Filed: Oct. 2, 2003

(65) Prior Publication Data

US 2004/0149753 A1 Aug. 5, 2004

(30) Foreign Application Priority Data

Feb. 1, 2003 (DE) ..... 203 01 545 U

(51) Int. Cl.[7] ..... B65D 8/14
(52) U.S. Cl. ..... 220/6; 220/7; 220/4.28
(58) Field of Search ..... 220/6, 7, 1.5, 4.28, 220/4.33, 4.34, 4.29, 642, 646, 650, 666, 669, 729, 315, 345.1, 345.2, 345.4, 351, 268, 266; 217/14, 15, 46; 229/117.07, 198.1; 206/300, 1.5

(56) References Cited

U.S. PATENT DOCUMENTS

| | | | | | |
|---|---|---|---|---|---|
| 1,488,418 | A | * | 3/1924 | Frederick | 220/7 |
| 3,796,342 | A | * | 3/1974 | Sanders et al. | 220/6 |
| 3,870,185 | A | * | 3/1975 | Sanders et al. | 220/6 |
| 4,062,467 | A | | 12/1977 | Friedrich | |
| 4,804,082 | A | * | 2/1989 | Stein | 206/1.5 |
| 4,863,056 | A | * | 9/1989 | Inayama | 220/6 |
| 4,913,302 | A | * | 4/1990 | Stonier | 220/6 |
| 5,038,953 | A | * | 8/1991 | Radar | 220/6 |
| 5,064,068 | A | * | 11/1991 | Sheng | 206/425 |
| 5,429,261 | A | * | 7/1995 | Machino | 220/7 |
| 6,230,916 | B1 | * | 5/2001 | Bradford et al. | 220/6 |
| 6,364,096 | B1 | * | 4/2002 | De Baets et al. | 206/1.5 |
| 6,467,843 | B1 | * | 10/2002 | Rossborough | 297/344.18 |
| 6,616,003 | B1 | * | 9/2003 | Polenta | 220/7 |

FOREIGN PATENT DOCUMENTS

| | | | |
|---|---|---|---|
| JP | 05319032 | A | * 12/1993 |
| JP | 06024440 | A | * 2/1994 |
| JP | 06247445 | A | * 9/1994 |

* cited by examiner

*Primary Examiner*—Stephen Castellano
*Assistant Examiner*—Harry Grosso
(74) *Attorney, Agent, or Firm*—Herbert Dubno; Andrew Wilford

(57) ABSTRACT

A collapsible shipping/storage box has a rectangular floor, a pair of parallel side walls having lower edges pivoted on the floor and movable between erect positions projecting upward from the floor and collapsed positions close to and generally parallel with the floor, and a pair of parallel end walls having lower edges pivoted on the floor between the side walls and movable between erect positions projecting upward from the floor and collapsed positions close to and generally parallel with the floor. A rigid annular top frame has side members at upper edges of the side walls and end members at upper edges of the end walls. Respective pivots or hinges are provided between the upper edges of the side walls and the side members. Latches secure the upper edges of the end walls to the end members only in the erect positions of the end walls.

15 Claims, 13 Drawing Sheets

COLLAPSIBLE STORAGE OR SHIPPING BOX

FIELD OF THE INVENTION

The present invention relates to a storage or shipping box. More particularly this invention concerns such a box that can be collapsed when not in use.

BACKGROUND OF THE INVENTION

A standard storage/shipping box as described in U.S. Pat. No. 4,062,467 has a rectangular floor, a pair of parallel side walls having lower edges pivoted on the floor and movable between erect positions projecting upward from the floor and collapsed positions close to and generally parallel with the floor, and a pair of parallel end walls having lower edges pivoted on the floor between the side walls and movable between erect positions projecting upward from the floor and collapsed positions close to and generally parallel with the floor. When erected the side and end walls fit together to form a fairly stable upwardly open box that can be provided with a removable cover. The pivots of the side and end walls are offset so that, for example, the end walls can be folded in to lie flatly atop the top face of the floor and the side walls can then be folded into lie flatly atop the folded-in end walls, forming a very compact package that can be sent back to the supplier for reuse.

In German utility model 92 03 114 based on French patent 2,673,910 of A. Triadu the side walls each include a bottom panel hinged to the floor and a top panel having a lower edge hinged to an upper edge of the respective bottom panel. Thus the side walls can be collapsed inward, making it possible for the box to be elongated parallel to the side walls and of a height greater than its width.

The problem with both of these boxes is that they are not strong enough. When stacked it is possible, if one of the walls is tipped, for the box to collapse and damage its contents. Furthermore, lifting the box by hand holes, normally in the end walls, means the entire weight of the box and its contents are borne by the hinges connecting the end walls to the floor of the box. Finally such boxes are often difficult to move between the set-up condition in which they can hold objects to be shipped or stored, and the collapsed condition in which they are shipped or stored when empty. Another disadvantage of the known boxes is that, when equipped with a cover, they can still be opened and closed without leaving any evidence of such tampering.

OBJECTS OF THE INVENTION

It is therefore an object of the present invention to provide an improved collapsible storage/shipping box.

Another object is the provision of such an improved collapsible storage/shipping box which overcomes the above-given disadvantages, that is which is easy to set up and collapse, yet which is very strong and stable when set up.

SUMMARY OF THE INVENTION

A collapsible shipping/storage box has a rectangular floor, a pair of parallel side walls having lower edges pivoted on the floor and movable between erect positions projecting upward from the floor and collapsed positions close to and generally parallel with the floor, and a pair of parallel end walls having lower edges pivoted on the floor between the side walls and movable between erect positions projecting upward from the floor and collapsed positions close to and generally parallel with the floor. In accordance with the invention a rigid annular top frame has side members at upper edges of the side walls and end members at upper edges of the end walls. Respective pivots or hinges are provided between the upper edges of the side walls and the side members. Latches secure the upper edges of the end walls to the end members only in the erect positions of the end walls.

Such a top frame greatly stabilizes the box since it is connected both to the side and end walls. The connection to the end walls via the latches is only effective when the box is erected, but then it ensures that, if for instance the box is lifted by hand holes in the top frame, force is transmitted between the top frame and the box floor via all four of the box walls. When the box is collapsed, the top frame sits on the folded-in side and end walls.

According to the invention a cover overlies the top frame, and formations releasably securing the cover to the top frame. These formations include L-shaped lugs on the cover and respective seats formed in the top frame. The cover and lugs are movable longitudinally between a holding position with the lugs hooked by the lugs to the top frame and the cover fitting snugly on the top frame and an offset position with the lugs displaceable into and out of the seats and the cover partially offset from the top frame. Thus the cover clips itself to the top frame which is, according to the invention, one piece so that the cover is solidly mounted in place. The cover has weakened tamper-indicating regions at which the lugs are attached to the cover. Thus if the cover is pried open, the lugs will break and leave obvious evidence of tampering.

The latches include projections extending from the upper edges of the end walls and each formed with a hole and respective horizontally projecting pins on the end members of the top frame fittable in the holes in the erect positions of the end walls. Thus the pins automatically fit into the holes when the end walls are erected, making setting-up of the box a very simple process. The end members of the top frame are formed with seats complementary to the projections and receiving the projections in the erect position. To facilitate fitting of the pins to the holes, the holes have beveled edges. The pins are tubularly hollow and each of the projections is inwardly open and the seats are inwardly and downwardly open.

The pivots in accordance with the invention include upwardly projecting pivot tabs on the upper edges of the side walls and downwardly open seats in which the tabs are pivoted on the side members of the top frame. These tabs can be dove-tail or T-shaped and their seats are complementary, so that a solid load-bearing pivot connection is formed between each side wall and the respective side member of the top frame. The side walls each include a top panel having the respective upper edge and a bottom panel hinged to the floor, and each top panel also has a lower edge hinged to an upper edge of the respective bottom panel.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
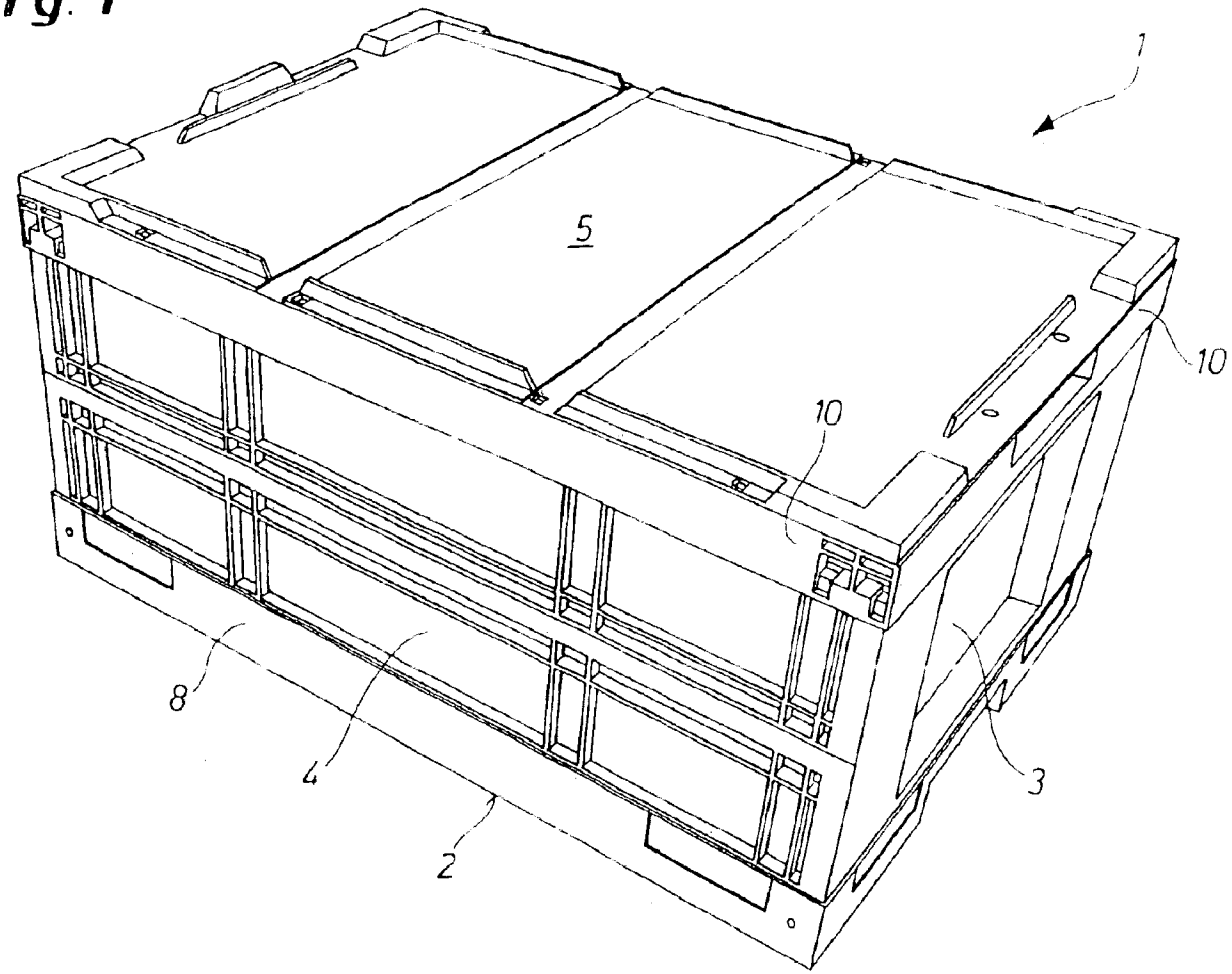
FIG. 1 is a perspective view of the box according to the invention in erected condition with its cover installed.

As seen in FIGS. 1 through 6 a box 1 according to the invention basically comprises a rectangular floor or base panel 2, a pair of short and parallel end walls 3, a pair of long and parallel side walls 4 each formed by a top panel 4*a* and a bottom panel 4*b* hinged together at 9, a rigid and one-piece top frame. 10, and a cover 5. All these parts are made of rigid molded plastic. The floor 2 is surrounded by a rectangular bottom frame 8 of the same size and overall shape as the top frame 10. The end walls 3 are hinged at 6 and the side walls 4 at 7 on they bottom frame 8, the pivot axis of the hinges 6 being below that of the hinges 7. The panels 4*a* and 4*b* are hinged together at 9 so that they can be folded in half and collapsed inward.

The upper side panels 4*a* have upper edges 11 provided with upwardly projecting dovetail or T-shaped formations 12 fitting in complementary formations or seats 13 of the long side members of the frame 10. The pivot formations 12 and 13 permit the panels 4*a* to swing through 90' relative to the frame 10 while remaining solidly fixed to the frame 10.

As shown in FIGS. 7 through 11, latches 14 between the end walls 8 and end members of the frame 10 are comprised of upwardly extending and inwardly open U-shaped projections 17 on the upper edges of the end walls 3 and inwardly open and outwardly closed complementary seats 15 of the frame 10. In addition the frame 10 is formed at each of the seats 15 with an inwardly projecting tubular latch pin 16 that engages in a respective horizontally throughgoing hole 18 in the respective projection 17, the holes 18 being beveled at 19 to allow easy fitting of the pins 16 to them. Furthermore upwardly projecting ribs 17*a* on the upper edges of the end walls 3 can snap into unillustrated downwardly open seats of the frame 10.

When the pins 16 are fitted to the holes 18, the top frame 10 is locked to the end walls 3 also, so that the entire box 1 can be lifted by the top frame 10 with force being transmitted to all the walls 3 and 4. The end walls 3 fit between the side walls 4 in the erected position of FIGS. 1–3 so that when they are raised they prevent inward buckling of the side walls 4 at the hinges 9 and make the erect box very strong.

Figure 2:
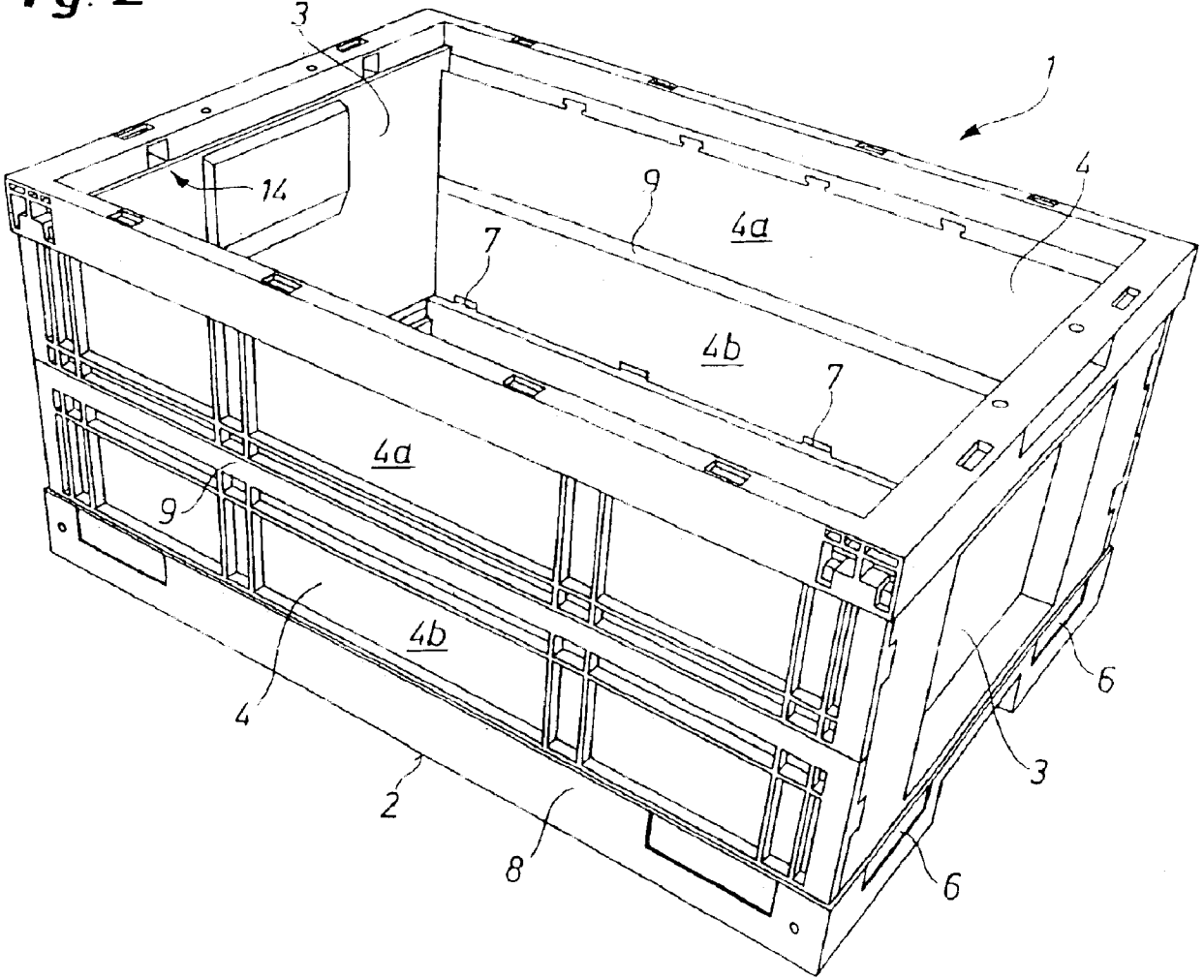
FIG. 2 is a perspective view of the box with its cover removed.
Figure 3:
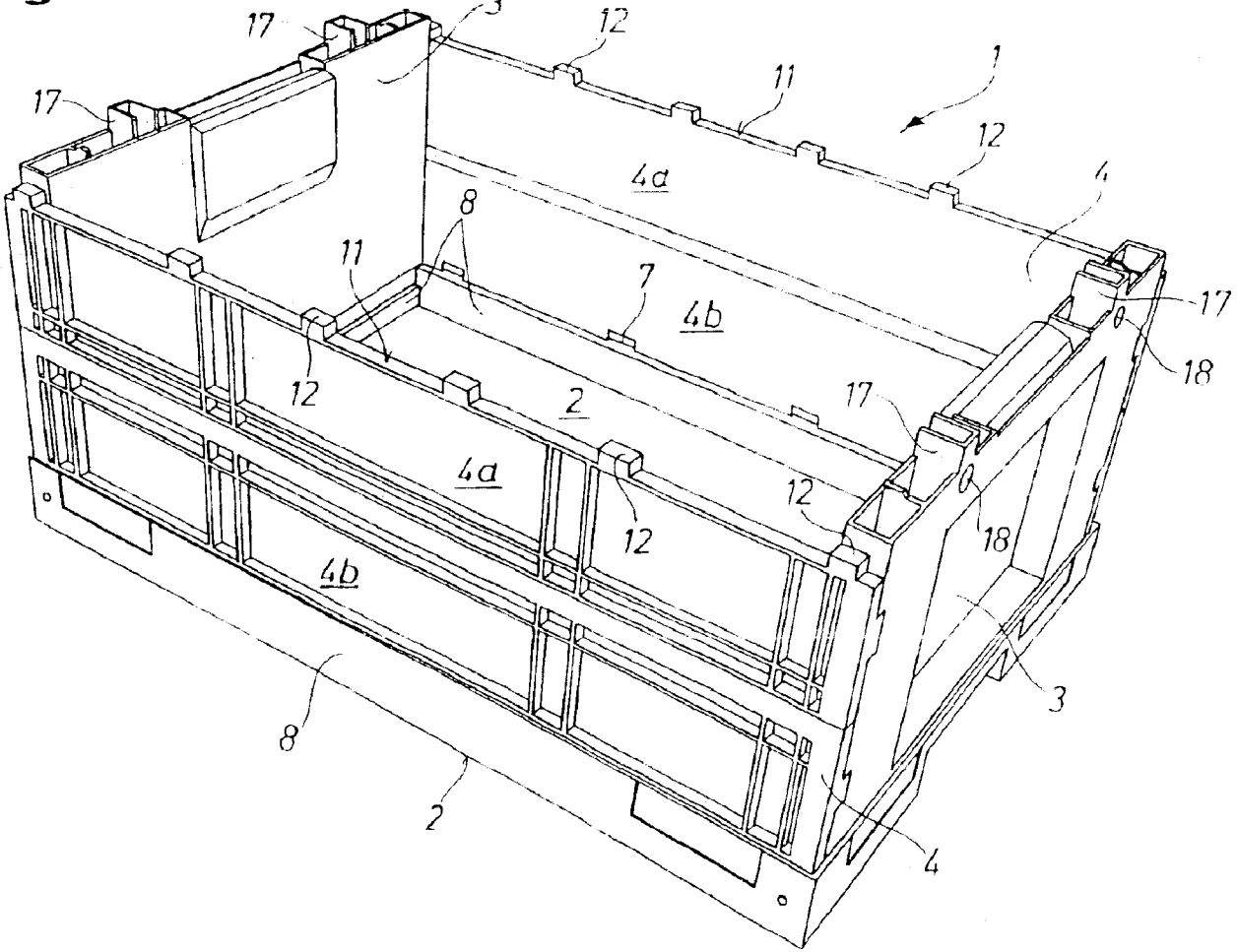
FIG. 3 is a perspective view of the box with its cover and top frame removed.
Figure 4:
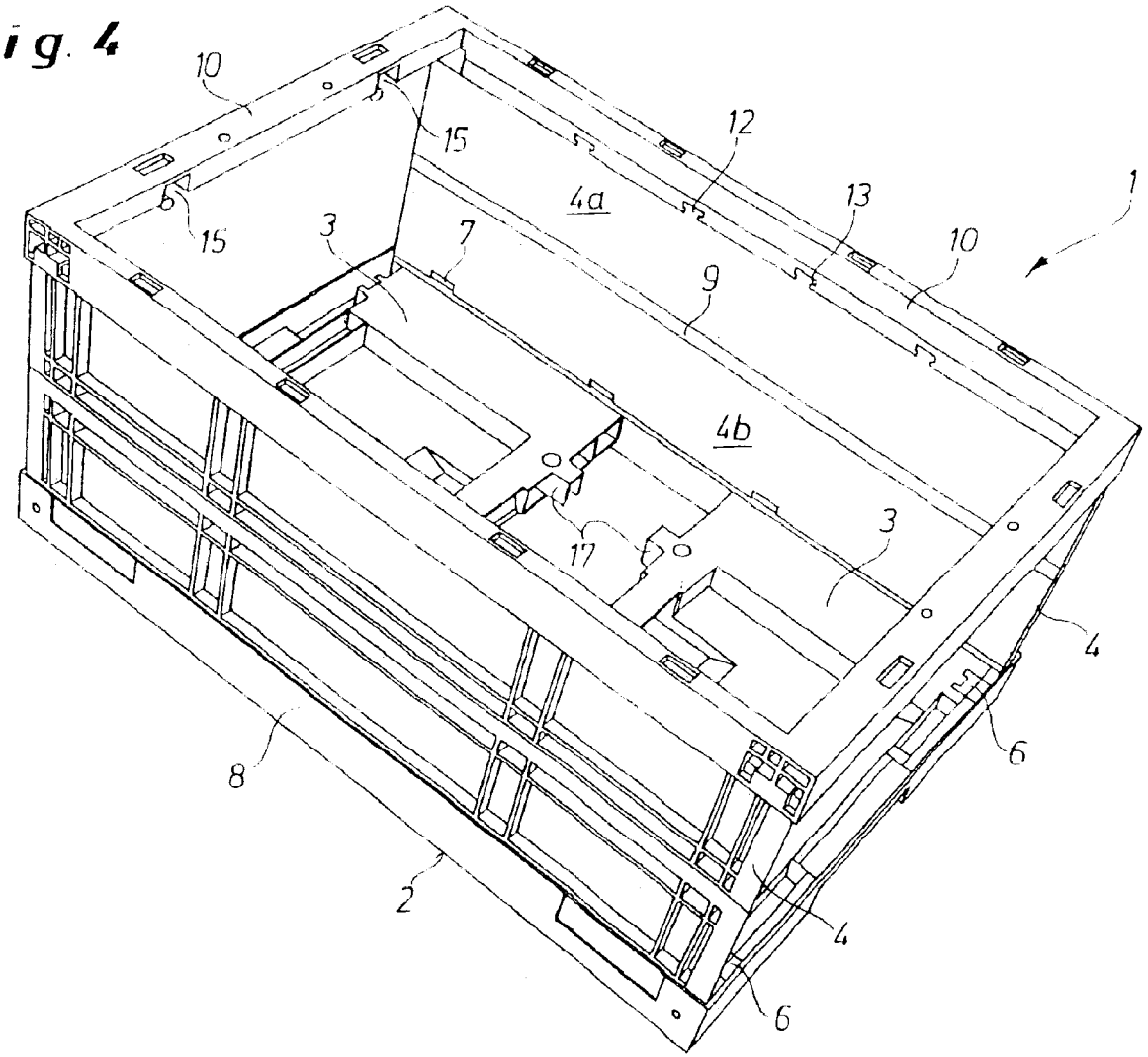
FIG. 4 is a perspective view of the box with its cover removed and its end walls folded down.
Figure 5:
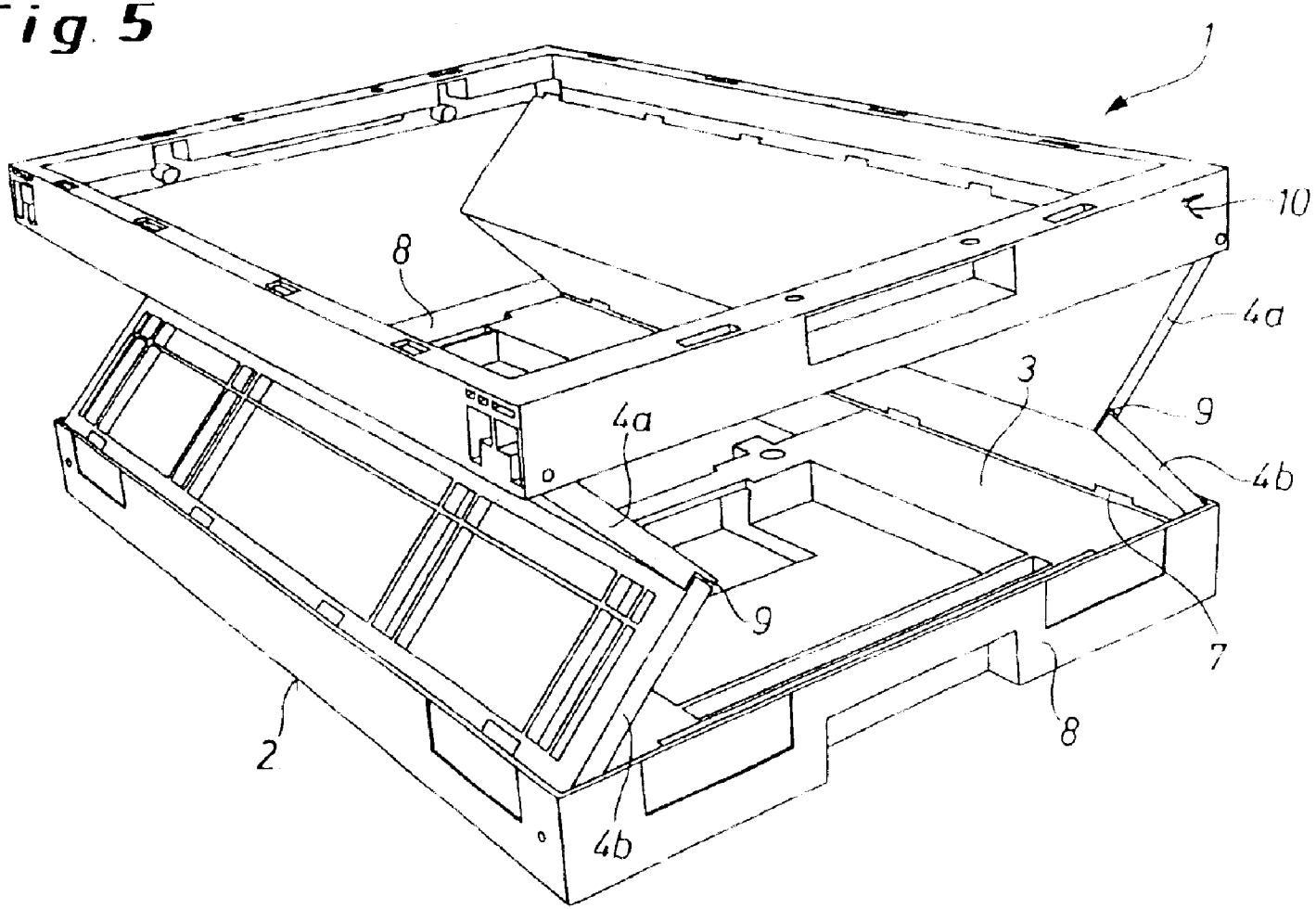
FIG. 5 is a perspective view of the box without its cover cover and partly collapsed.
Figure 6:
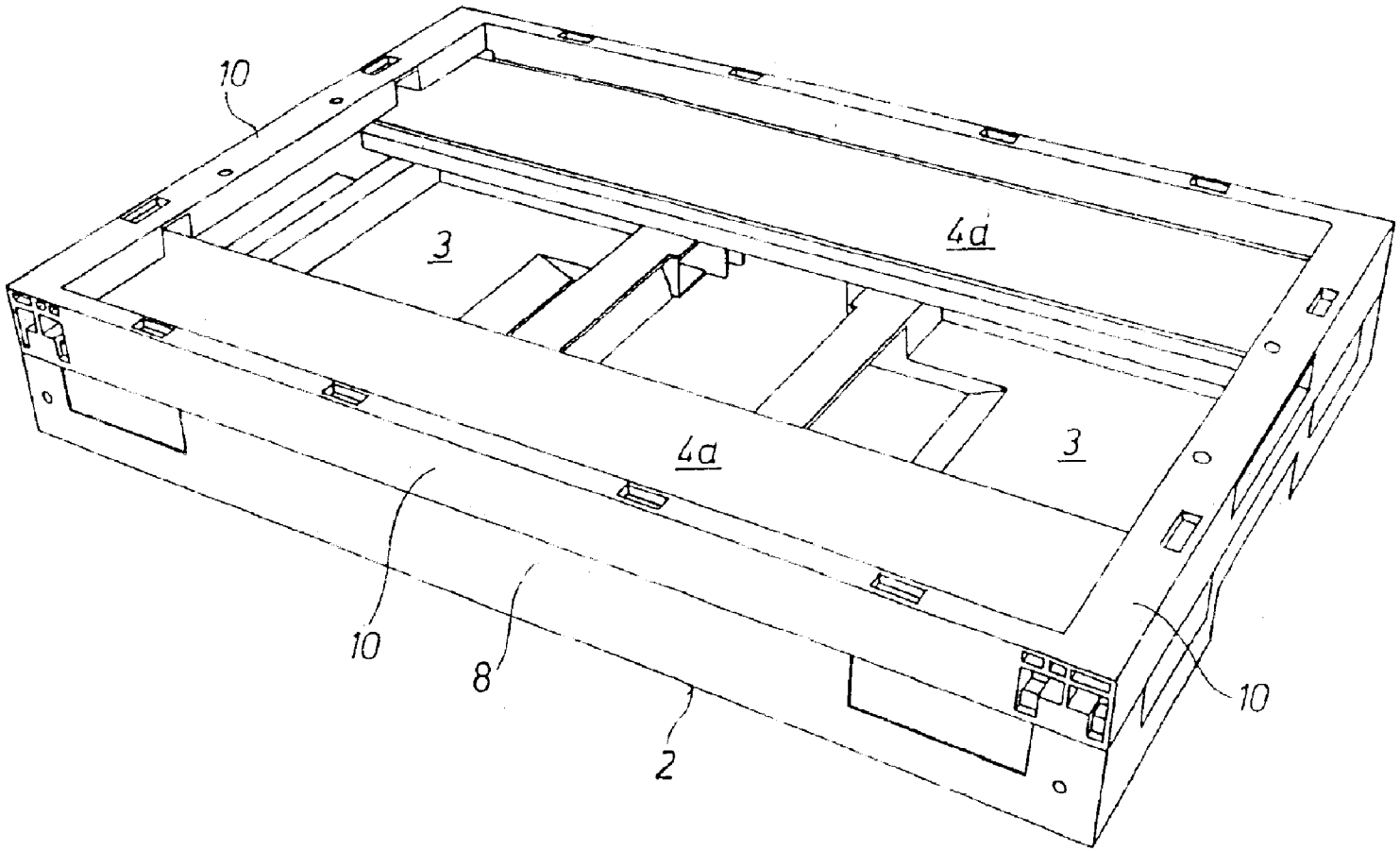
FIG. 6 is a view like FIG. 5 but with the box completely collapsed.
Figure 7:
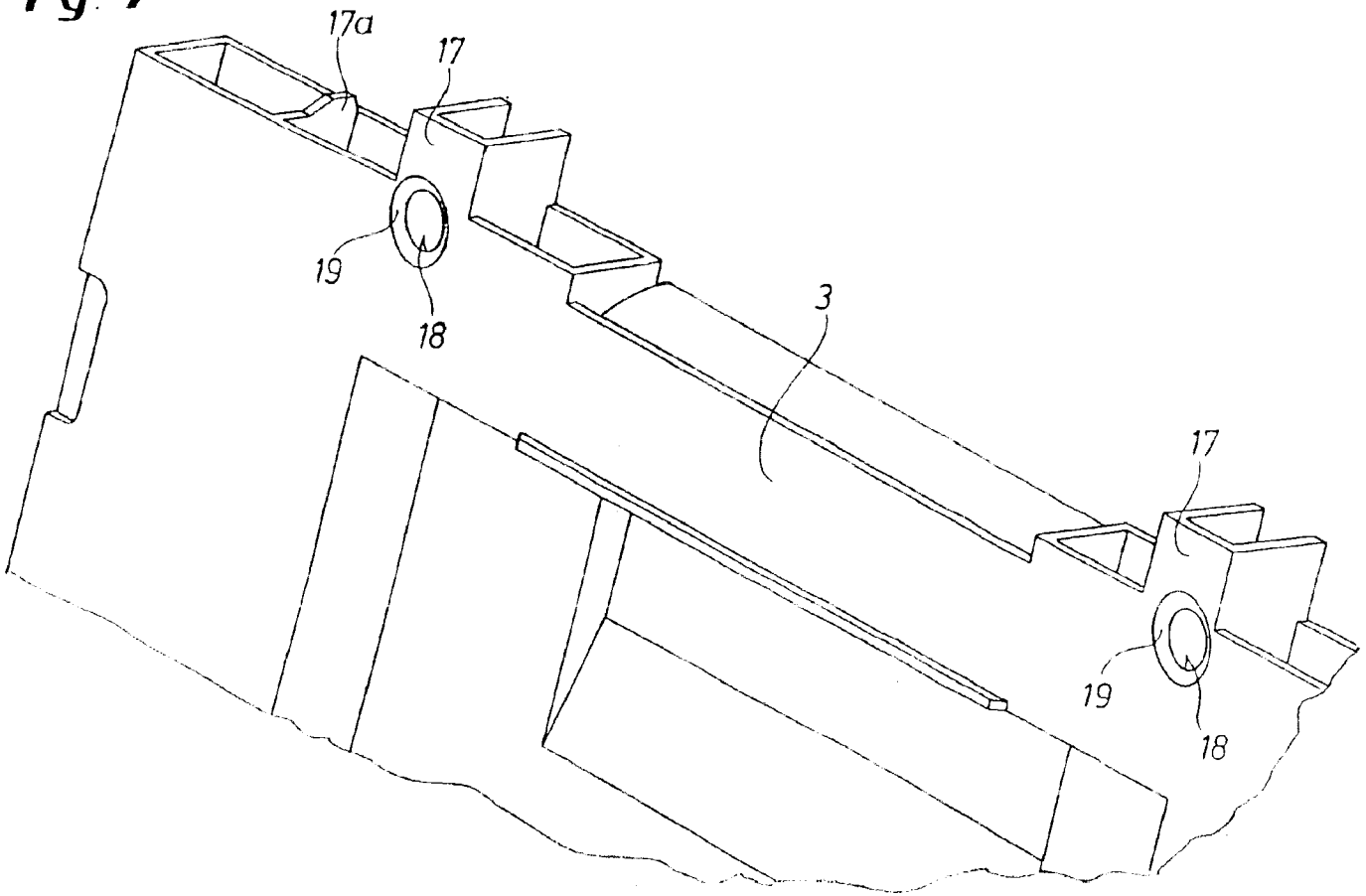
FIGS. 7 and 8 are detail views from inside and outside of portions of the end walls.
Figure 8:
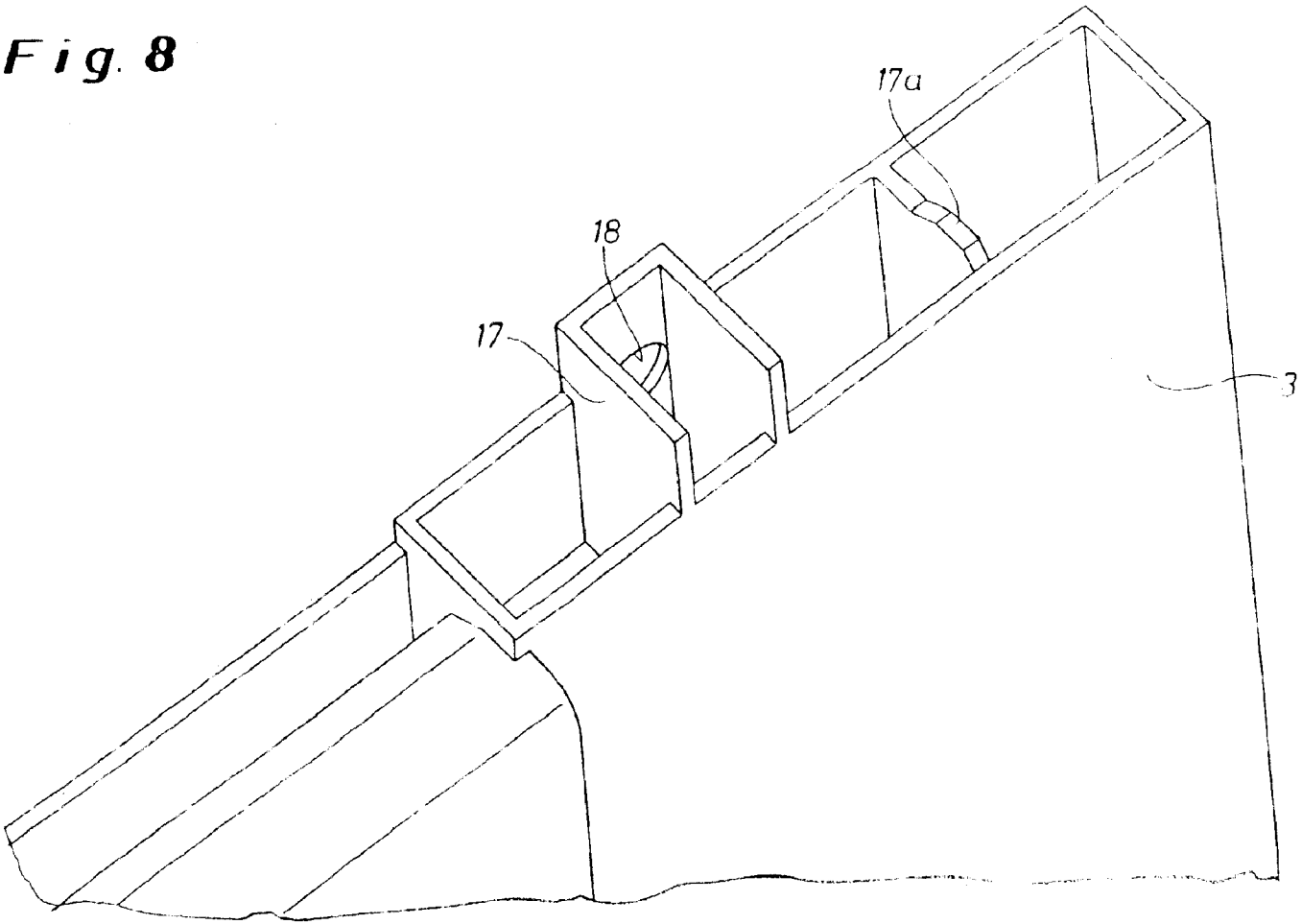
Figure 9:
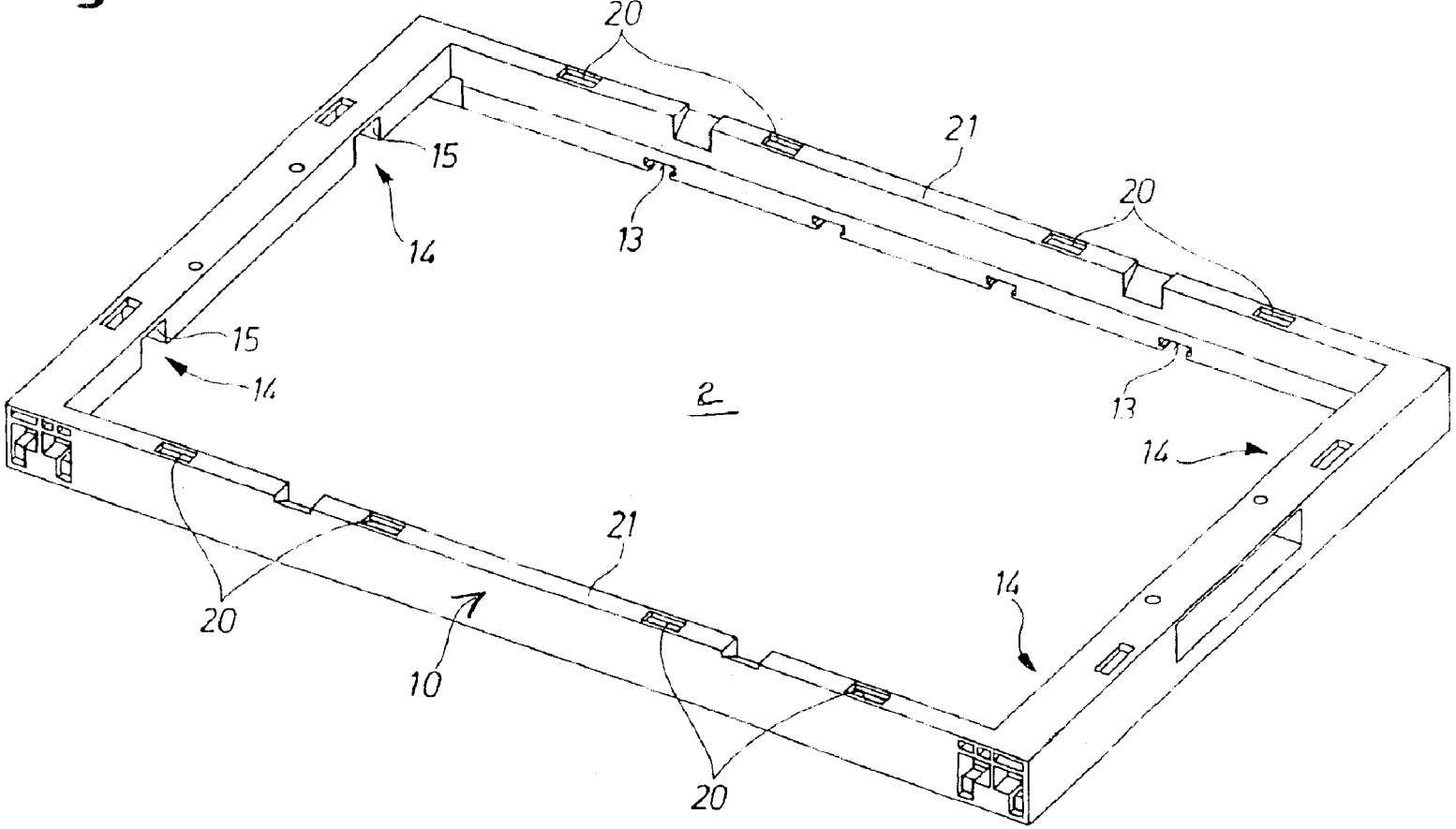
FIG. 9 is a perspective view of the top frame.
Figure 10:
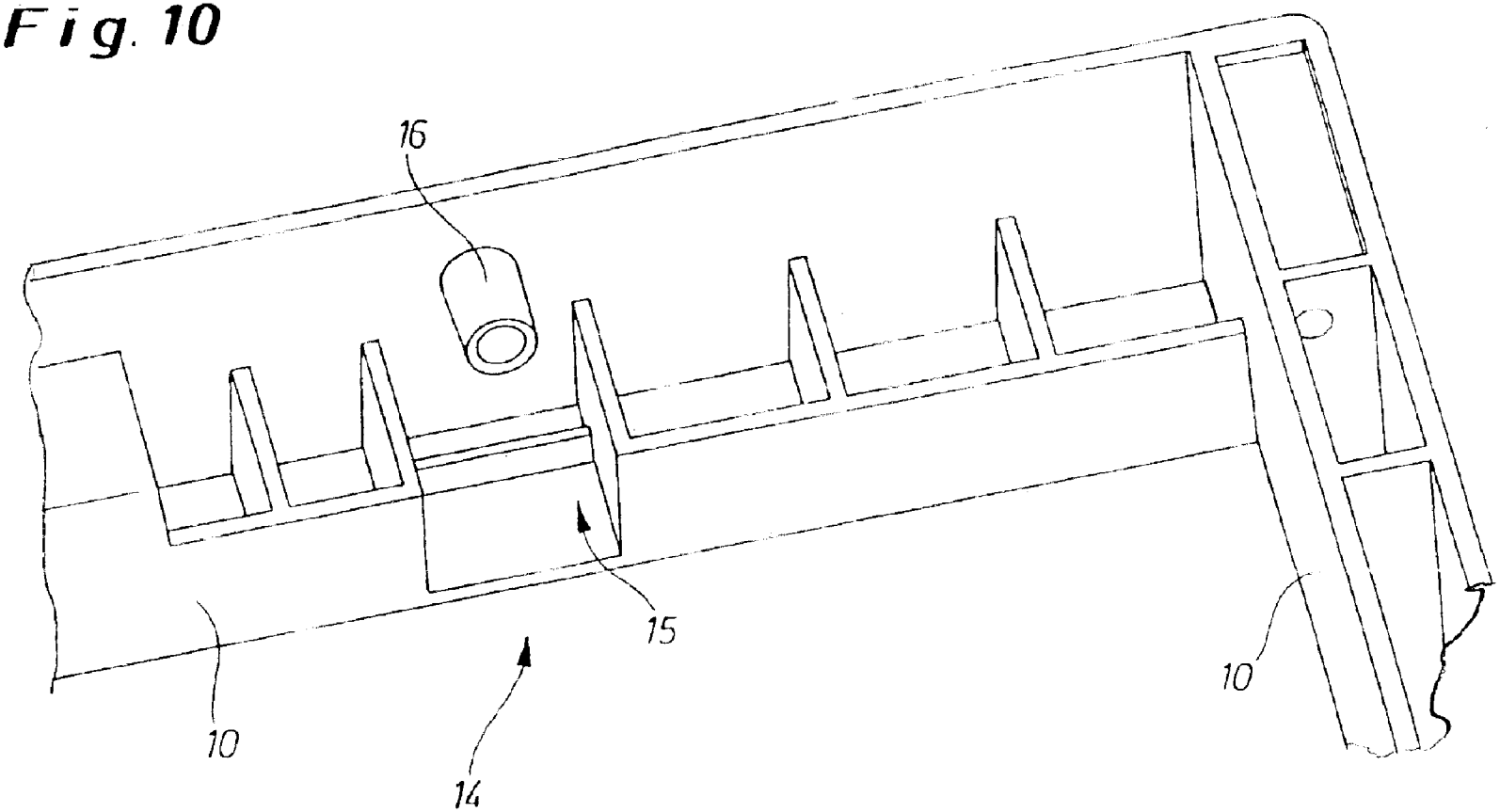
FIG. 10 is a detail view from inside of the top frame.
Figure 11:
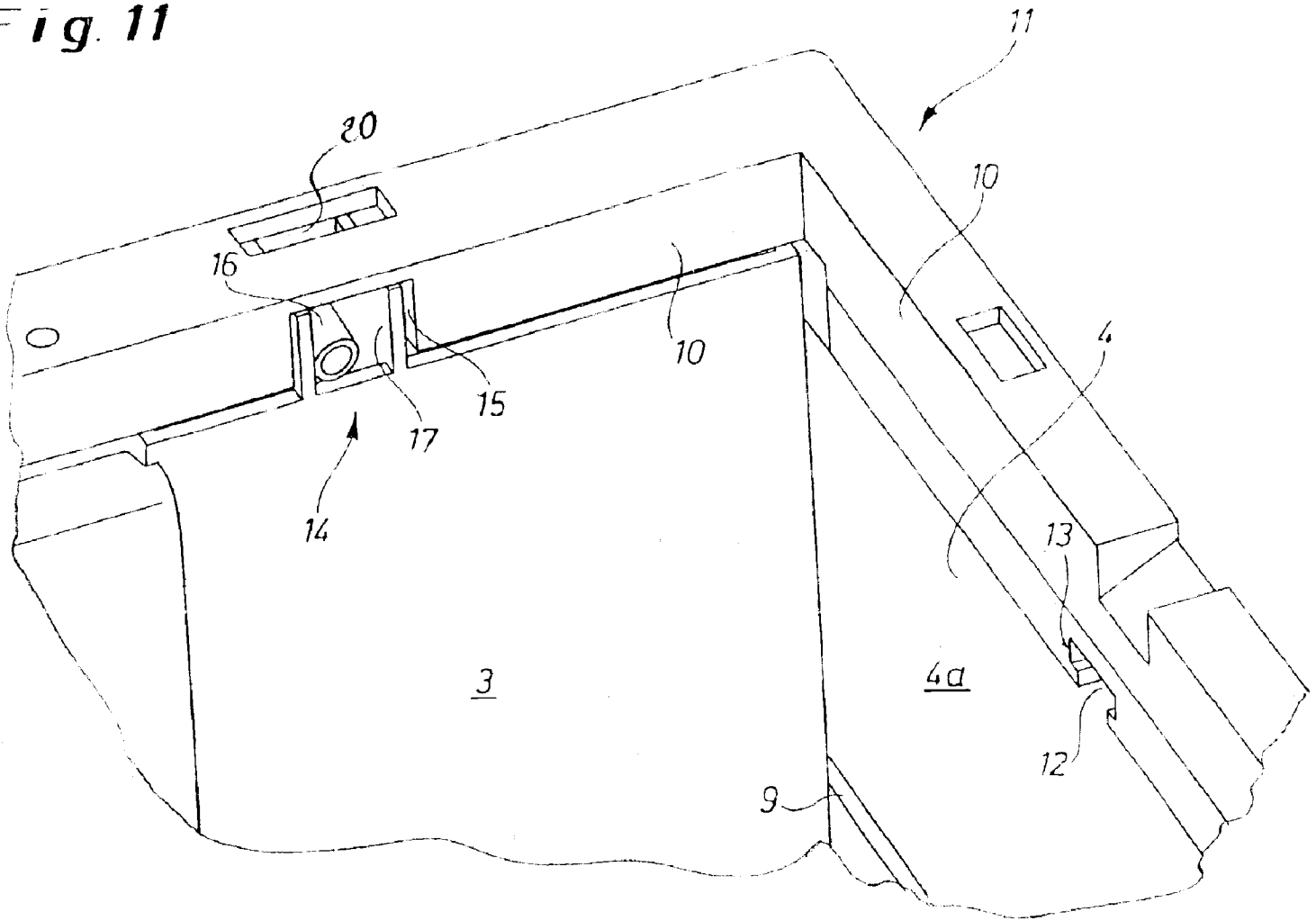
FIGS. 11 and 12 are detail views from inside and outside of an upper corner of the box as in FIG. 2.

It is possible to collapse the box 1 by first pivoting the end walls 3 inwardly on their hinges 6 from the FIG. 2 position to the FIG. 4 position in which they lie on the floor 2. Then the side walls 4 are folded inward by pushing in their centers at the hinges 9 as shown by FIG. 5, thereby dropping the frame 10, until it sits atop the frame 8 as shown in FIG. 6.

The box 1 is erected by opposite action. Starting from the position of FIG. 6, the top frame 10 is lifted through the position of FIG. 5 until each of the panels 4*a* is coplanar with the respective panel 4*b*. Then the end walls 3 are swung up between the side walls 4. This action snaps the ribs 17*a* into the frame 10 and fits the pins 16 into the holes 18, locking the frame 10 vertically to the end walls 3.

Figure 12:
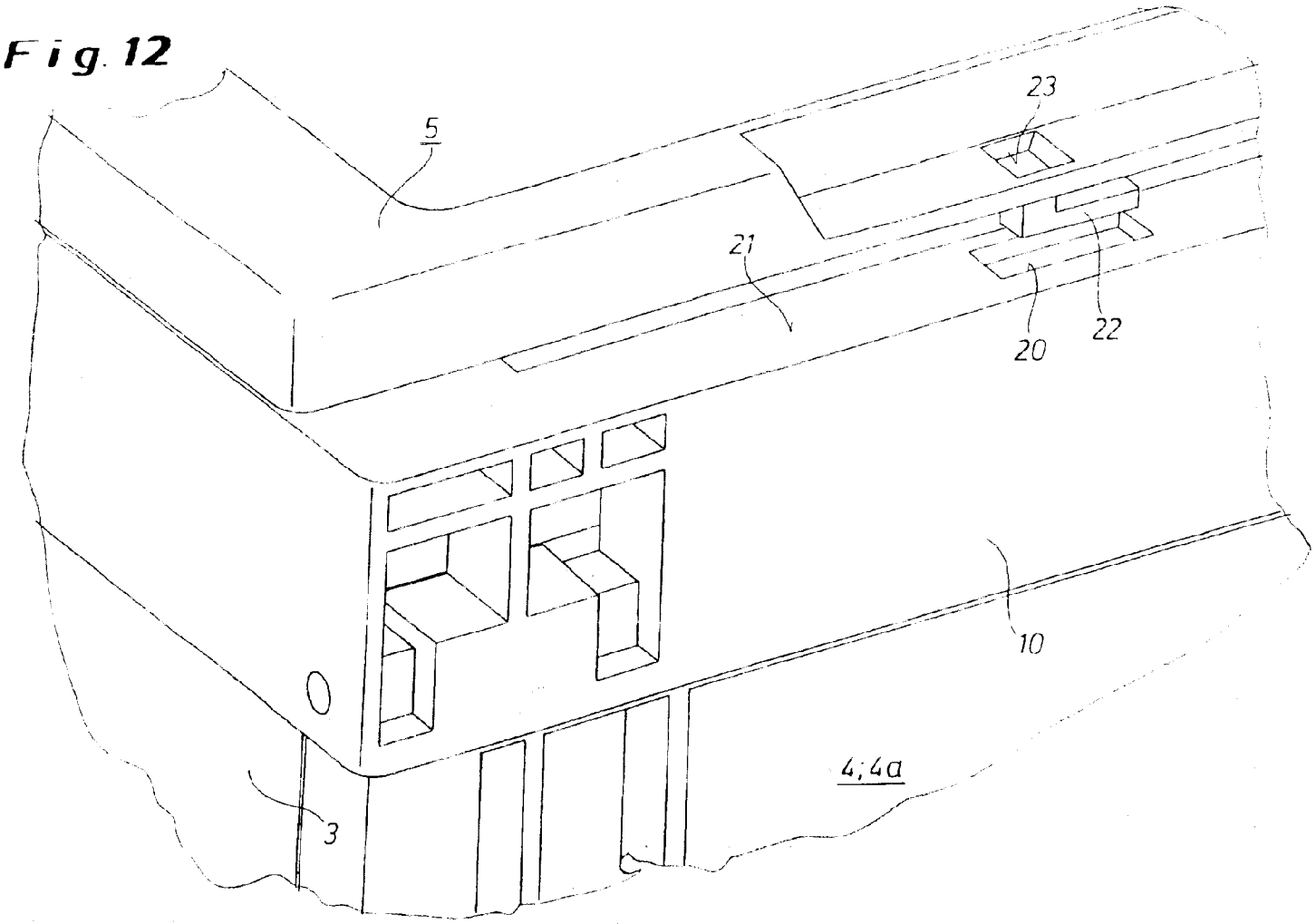
Figure 13:
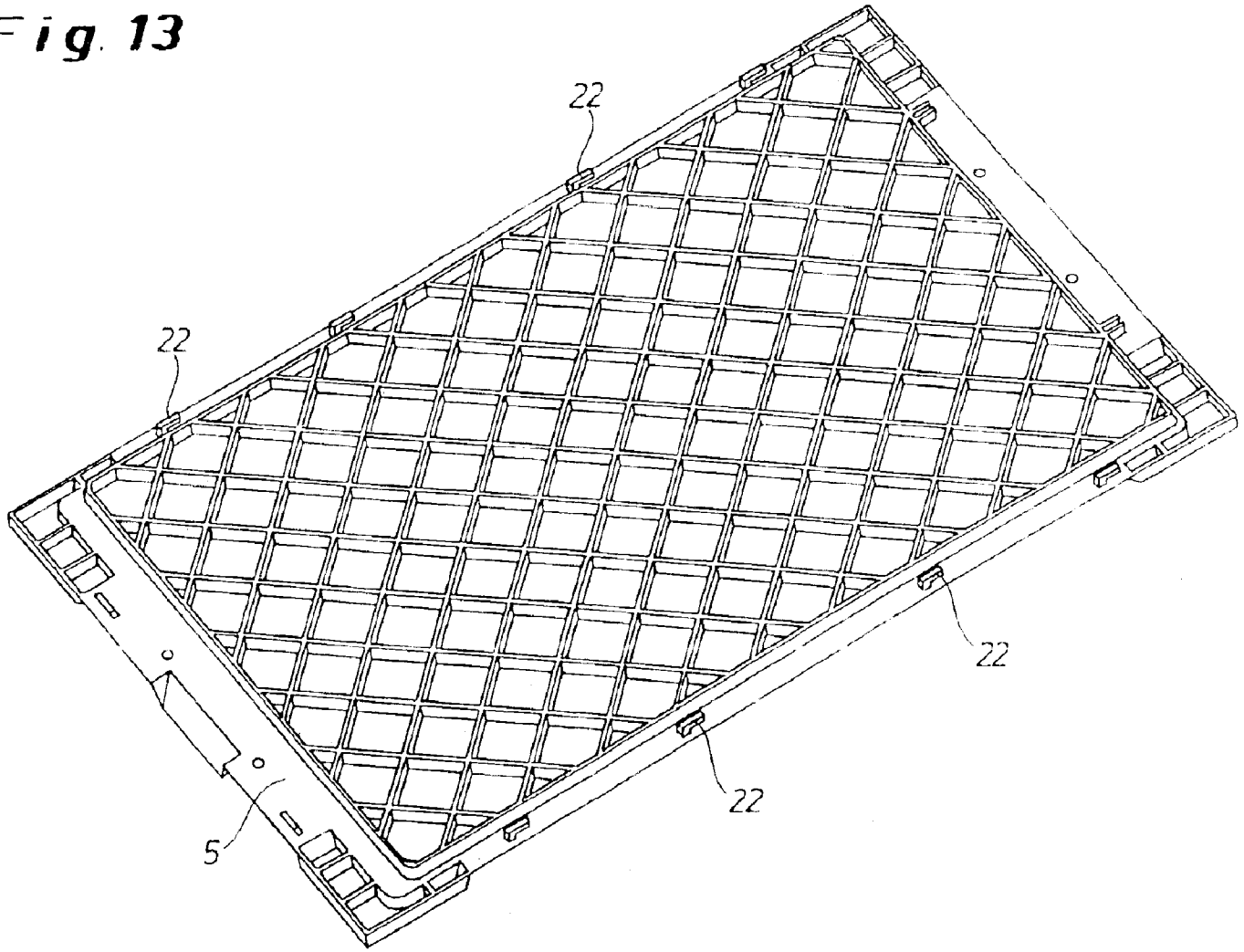
FIG. 13 is a perspective view from underneath of the box cover.

The cover 5 as shown in FIGS. 12 and 13 is basically rectangular and formed around its two long edges with downwardly projecting L-shaped lugs 22 engageable through holes 20 in an upper edge 21 of the top frame 10. Once the lugs 22 are engaged through these holes 20, the entire cover 5 can be shifted longitudinally, that is parallel to the side walls 4, slightly so as to lock the lugs 22 to the frame 10 and align the cover congruently on the top frame 10. The lugs 22 are attached at weakened tamper-indicating regions 23 to the cover 5 so that, if the cover 5 is forcibly pried up away from the frame 10, the lugs 22 will break off and offer unmistakable proof of tampering. Thus the cover 5, once it is fitted in place, need merely be secured by a padlock, seal, or even a tape prohibiting it from sliding longitudinally on the frame 10 to effectively close the box 1 and make it impossible to open without leaving proof.

I claim:

1. A collapsible shipping/storage box comprising:

a rectangular floor;

a pair of parallel side walls having lower edges pivoted on the floor and movable between erect positions projecting upward from the floor and collapsed positions close to and generally parallel with the floor;

a pair of parallel end walls having lower edges pivoted on the floor between the side walls and movable between erect positions projecting upward from the floor and collapsed positions close to and generally parallel with the floor;

a rigid annular top frame having side members at upper edges of the side walls and end members at upper edges of the end walls;

respective pivots between the upper edges of the side walls and the side members;

means for latching securing the upper edges of the end walls to the end member only in the erect positions of the end walls, the means for latching including projections extending from the upper edges of the end walls and each formed with a hole, respective horizontally projecting tubularly hollow pins on the end members of the top frame fittable in the holes in the erect positions of the end walls, and seats formed in end members of the top frame, complementary to the projections, and receiving the projections in the erect position.

2. The collapsible shipping/storage box defined in claim 1, further comprising a cover overlying the top frame; and formations releasably securing the cover to the top frame.

3. The collapsible shipping/storage box defined in claim 2 wherein the formations include L-shaped lugs on the cover and respective seats formed in the top frame, the cover and lugs being movable longitudinally between a holding position with the lugs hooked by the lugs to the top frame and the cover fitting snugly on the top frame and an offset position with the lugs displaceable into and out of the seats and the cover partially offset from the top frame.

4. The collapsible shipping/storage box defined in claim 3 wherein the cover has weakened tamper-indicating regions at which the lugs are attached to the cover.

5. The collapsible shipping/storage box defined in claim 1 wherein the holes have beveled edges.

6. The collapsible shipping/storage box defined in claim 1 wherein the pivots include upwardly projecting pivot tabs on the upper edges of the side walls and downwardly open seats in which the tabs are pivoted on the side members of the top frame.

7. The collapsible shipping/storage box defined in claim 1 wherein the side walls each include a top panel having the respective upper edge and a bottom panel hinged to the floor, each top panel also having a lower edge hinged to an upper edge of the respective bottom panel.

8. The collapsible shipping/storage box defined in claim 4 wherein the pivots include upwardly projecting pivot tabs on the upper edges of the side walls and downwardly open seats in which the tabs are pivoted on the side members of the top frame.

9. The collapsible shipping/storage box defined in claim 4 wherein the side walls each include a top panel having the respective upper edge and a bottom panel hinged to the floor, each top panel also having a lower edge hinged to an upper edge of the respective bottom panel.

10. A collapsible shipping/storage box comprising:

a rectangular floors;

a pair of parallel side walls having lower edges pivoted on the floor and movable between erect positions projecting upward from the floor and collapsed positions close to and generally parallel with the floor;

a pair of parallel end walls having lower edges pivoted on the floor between the side walls and movable between erect positions projecting upward from the floor and collapsed positions close to and generally parallel with the floor;

a rigid annular top frame having side members at upper edges of the side walls and end members at upper edges of the end walls;

respective pivots between the upper edges of the side walls and the side members;

means for latching securing the upper edges of the end walls to the end members only in the erect positions of the end walls, the means for latching including inwardly open projections extending from the upper edges of the end walls and each formed with a hole, respective horizontally projecting pins on the end members of the toy frame fittable in the holes in the erect positions of the end walls, and seats formed in end members of the top frame, complementary to the projections, and receiving the projections in the erect position.

11. The collapsible shipping/storage box defined in claim 10 wherein the seats are downwardly open.

12. The collapsible shipping/storage box defined in claim 10 further comprising a cover overlying the top frame; and formations releasably securing the cover to the top frame.

13. The collapsible shipping/storage box defined in claim 12 wherein the formations include L-shaped lugs on the cover and respective seats formed in the top frame, the cover and lugs being movable longitudinally between a holding position with the lugs hooked by the lugs to the top frame and the cover fitting snugly on the top frame and an offset position with the lugs displaceable into and out of the seats and the cover partially offset from the top frame.

14. The collapsible shipping/storage box defined in claim 10 wherein the pivots include upwardly projecting pivot tabs on the upper edges of the side walls and downwardly open seats in which the tabs are pivoted on the side members of the top frame.

15. The collapsible shipping/storage box defined in claim 10 wherein the side walls each include a top panel having the respective upper edge and a bottom panel hinged to the floor, each top panel also having a lower edge hinged to an upper edge of the respective bottom panel.

* * * * *